US010767349B2

(12) United States Patent
Motomura

(10) Patent No.: US 10,767,349 B2
(45) Date of Patent: Sep. 8, 2020

(54) BUCKET TIP END COVER

(71) Applicant: SEIKI KOEI CORPORATION, Higashiosaka-shi, Osaka (JP)

(72) Inventor: Yasunori Motomura, Higashiosaka (JP)

(73) Assignee: SEIKI KOEI CORPORATION, Higashiosaka-Shi, Osaka (JP)

( * ) Notice: Subject to any disclaimer, the term of this patent is extended or adjusted under 35 U.S.C. 154(b) by 16 days.

(21) Appl. No.: 16/225,971

(22) Filed: Dec. 19, 2018

(65) Prior Publication Data

US 2020/0032491 A1 Jan. 30, 2020

(30) Foreign Application Priority Data

Jul. 28, 2018 (JP) ..... 2018-141911

(51) Int. Cl.
*E02F 9/28* (2006.01)
*E02F 3/40* (2006.01)

(52) U.S. Cl.
CPC ..... *E02F 9/2825* (2013.01); *E02F 3/40* (2013.01); *E02F 9/2883* (2013.01)

(58) Field of Classification Search
CPC ..... E02F 9/2825; E02F 9/2883; E02F 3/40
USPC ..... 37/444
See application file for complete search history.

(56) References Cited

U.S. PATENT DOCUMENTS

2014/0059900 A1 3/2014 Tanaka et al.

FOREIGN PATENT DOCUMENTS

JP 2013-245529 12/2013
JP 2017-25578 2/2017

OTHER PUBLICATIONS

Notification of Reasons for Refusal for JP Patent Application No. 2018-141911, dated Oct. 11, 2018, 5 pages.

*Primary Examiner* — Tara Mayo-Pinnock
(74) *Attorney, Agent, or Firm* — Nixon & Vanderhye P.C.

(57) ABSTRACT

A bucket tip end cover 1 includes multiple cover members 10, 20 arranged at a tip end of a bucket 5 between adjacent ones of adaptors 7. The multiple cover members 10, 20 are fixed to the bucket 5 in a state in which an entire width in an arraying direction A of the adaptors 7 is adjusted in such a manner that each cover member 10, 20 relatively moves in the arraying direction A.

5 Claims, 20 Drawing Sheets

BUCKET TIP END COVER

This application claims priority to JP 2018-141911 filed Jul. 28, 2018, the entire contents of each of which are hereby incorporated by reference.

TECHNICAL FIELD

The present disclosure relates to a bucket tip end cover attached to a tip end side of a bucket for a shovel machine.

BACKGROUND ART

For example, for a bucket of a shovel machine such as a power shovel or a shovel loader, multiple adaptors are fixed to a tip end of the bucket at predetermined intervals. For example, a claw-shaped tooth as a drilling tool is attached to a tip end of each adaptor. The tooth protrudes from the tip end of the bucket.

Patent Literature 1 describes that a bucket tip end cover (a shroud) is fixed to a tip end of a bucket exposed between adjacent teeth. The bucket tip end cover is fixed to the bucket tip end, and therefore, the bucket tip end is protected. Generally, the bucket tip end cover is made of metal such as casting iron, and is fixed to the plate-shaped bucket tip end by welding.

CITATION LIST

Patent Literature

PATENT LITERATURE 1: Japanese Unexamined Patent Application Publication No. 2013-245529

SUMMARY OF THE INVENTION

Problems to be Solved by the Invention

The interval of adjacent adaptors (i.e., a tooth interval) varies according to the type and size of the bucket. Thus, for properly covering and protecting the bucket tip end between the adaptors, multiple types of bucket tip end covers with different sizes are preferably prepared for various different adaptor intervals. However, there is a problem that it is difficult to prepare the multiple types of bucket tip end covers in advance, considering a manufacturing cost and inventory control.

The present disclosure has been made in view of the above-described point, and is intended to modify a configuration of a bucket tip end cover to enhance even protection of a tip end of a bucket with different adaptor intervals.

Solution to the Problems

The present disclosure relates to a bucket tip end cover fixed to a tip end of a bucket exposed in a state in which drilling tools are each attached to adaptors to protect the tip end of the bucket, the adaptors being provided at a predetermined interval at the bucket. The bucket tip end cover includes a first cover member and a second cover member arranged at the tip end of the bucket between adjacent ones of the adaptors. The first cover member and the second cover member are fixed to the bucket in a state in which an entire width in an arraying direction of the adaptors is adjusted in such a manner that each cover member relatively moves in the arraying direction. The first cover member includes a first base portion provided along an inner surface or an outer surface of the bucket, and a first front end portion standing at a front end of the first base portion to cover the tip end of the bucket. The second cover member includes a second base portion provided along the inner surface or the outer surface of the bucket, and a second front end portion standing at a front end of the second base portion to cover the tip end of the bucket. A cutout portion is formed at the substantially center of the first base portion. A center protruding portion having a front surface configured to support a back surface of the cutout portion is formed at the second base portion.

Effects of the Invention

According to the present disclosure, even protection of a tip end of a bucket with different adaptor intervals can be enhanced.

DESCRIPTION OF THE EMBODIMENTS

Hereinafter, the present embodiments will be described in detail with reference to the drawings. Note that the present disclosure is not limited to the embodiments below.

First Embodiment

Figure 1:
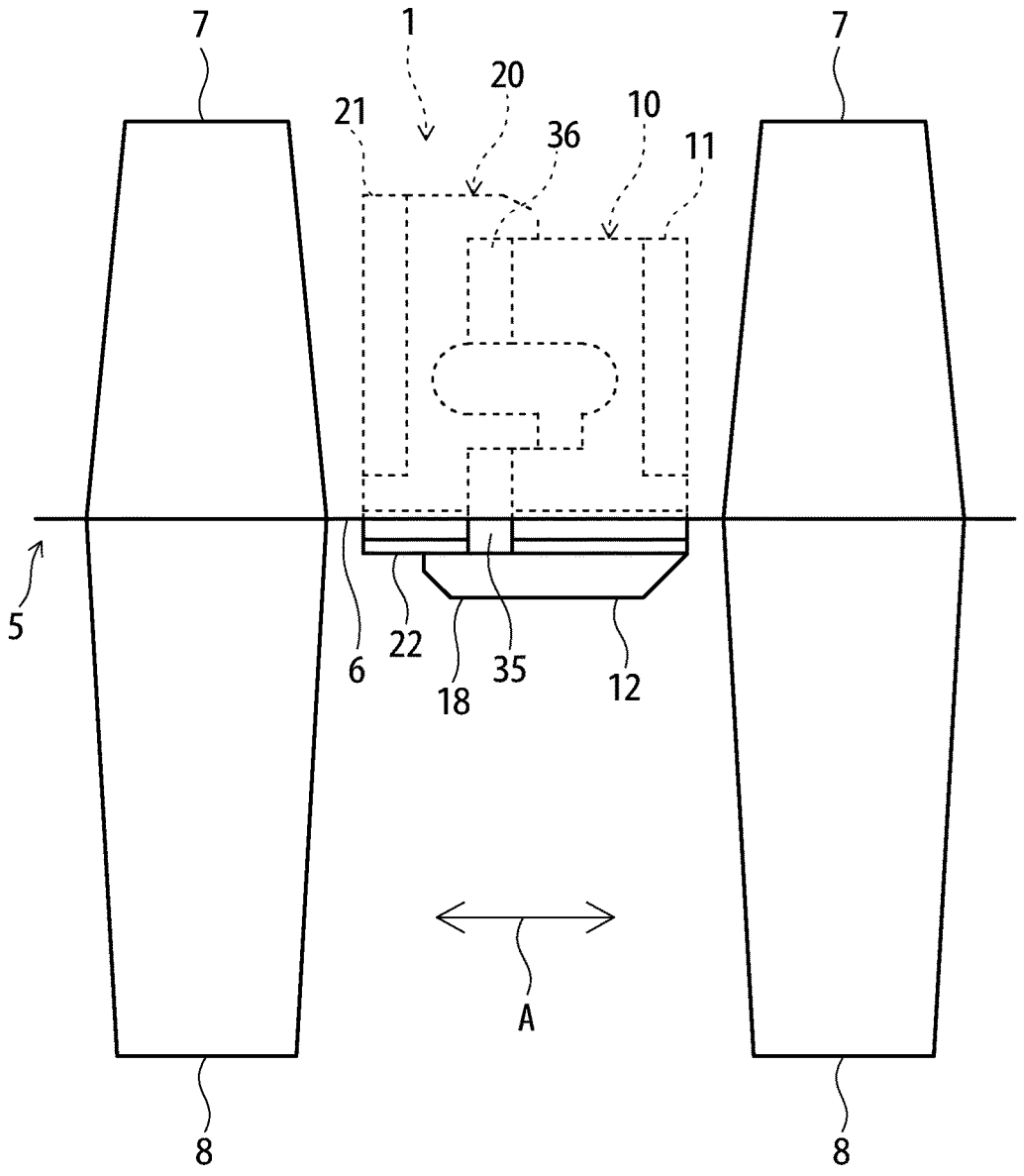
FIG. 1 is an enlarged partial plan view of a tip end of a bucket attached to a bucket tip end cover in a first embodiment.
Figure 2:
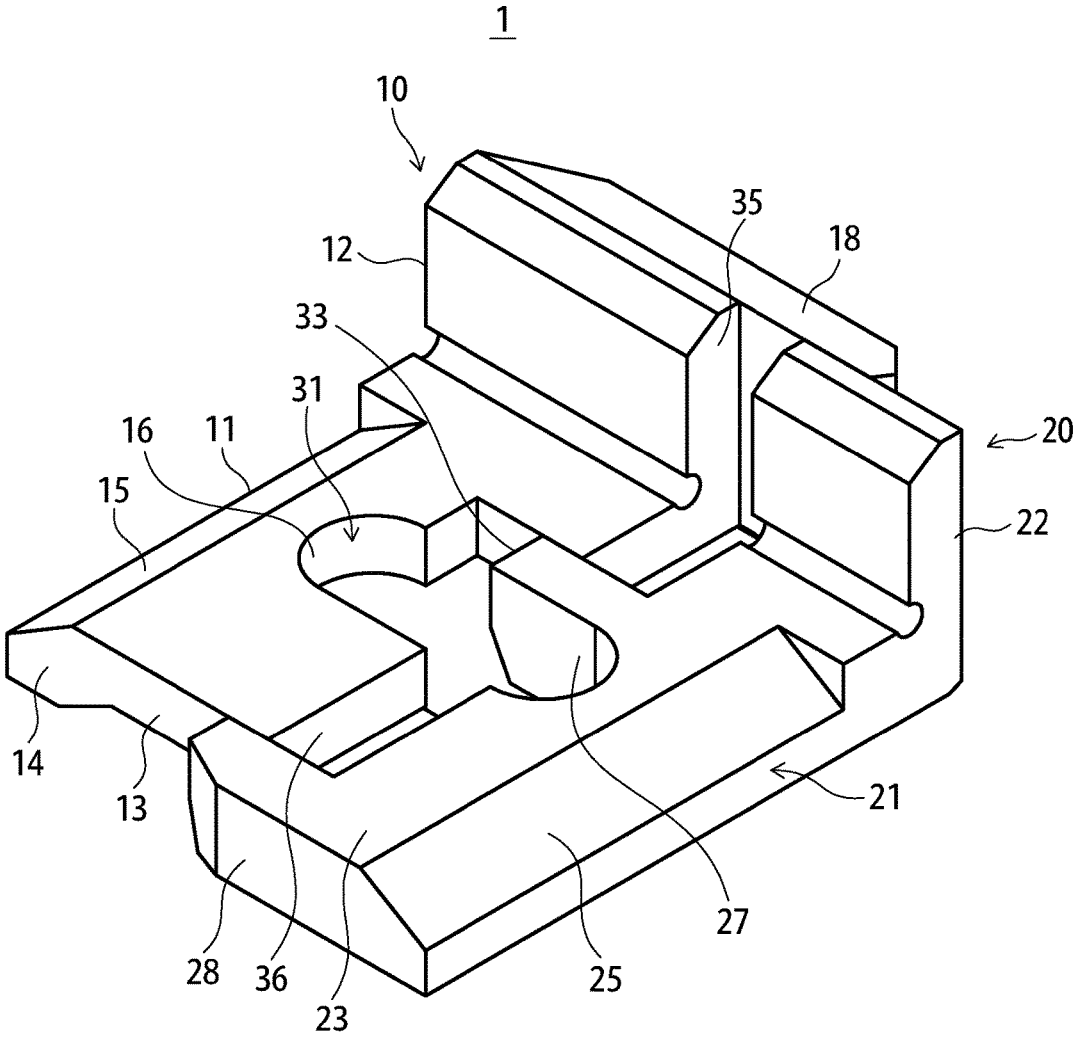
FIG. 2 is a perspective view of the bucket tip end cover whose width is expanded.
Figure 3:
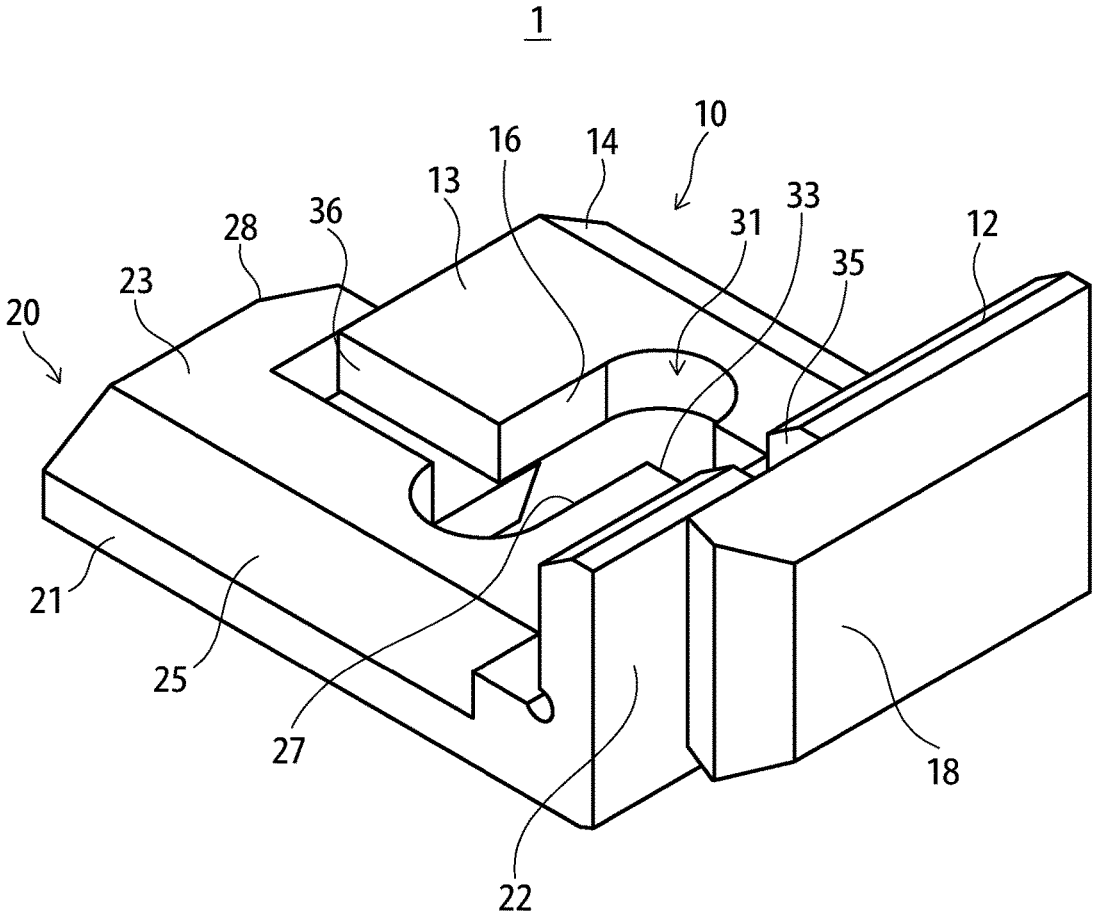
FIG. 3 is a perspective view of the bucket tip end cover whose width is expanded.
Figure 4:
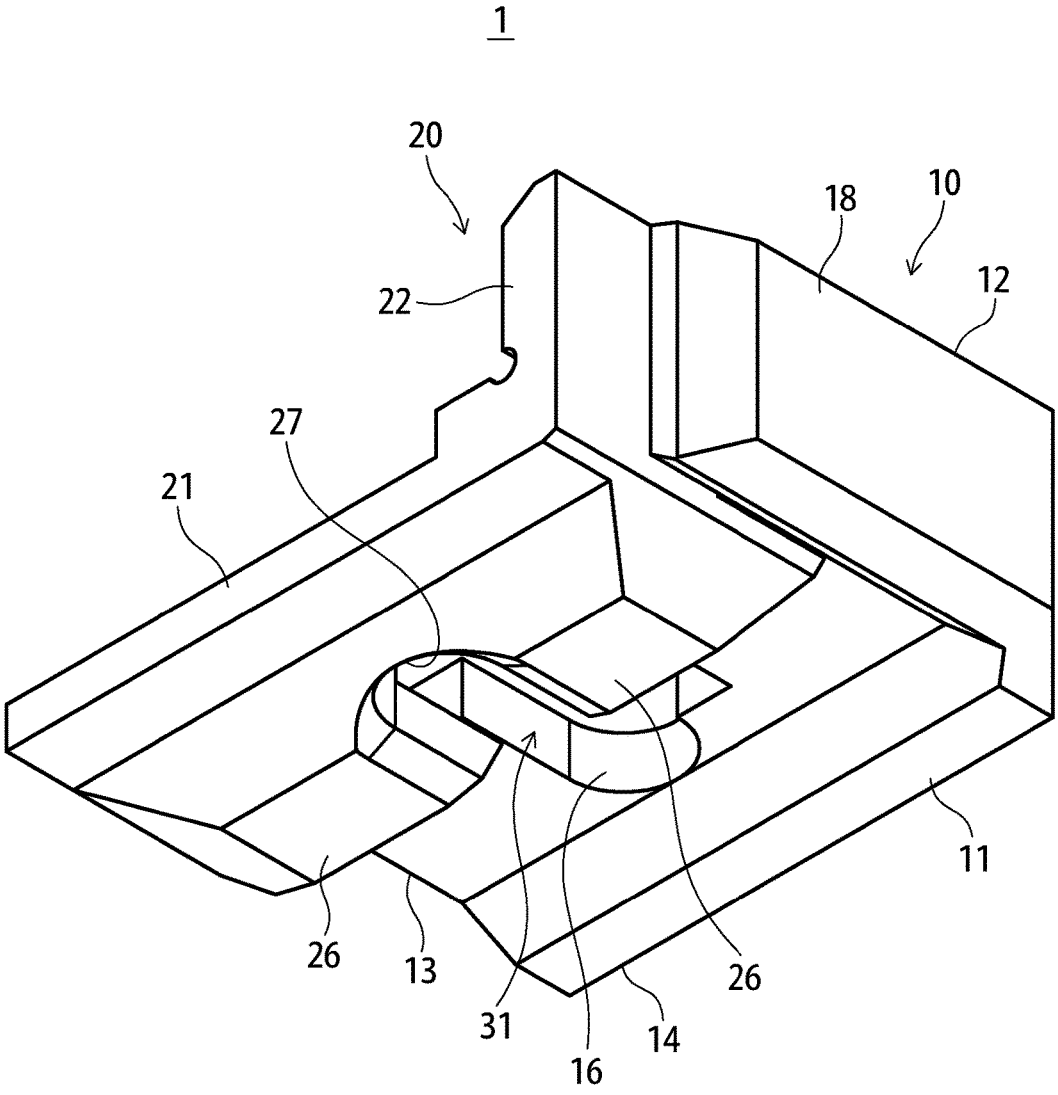
FIG. 4 is a perspective view of the bucket tip end cover whose width is expanded.
Figure 5:
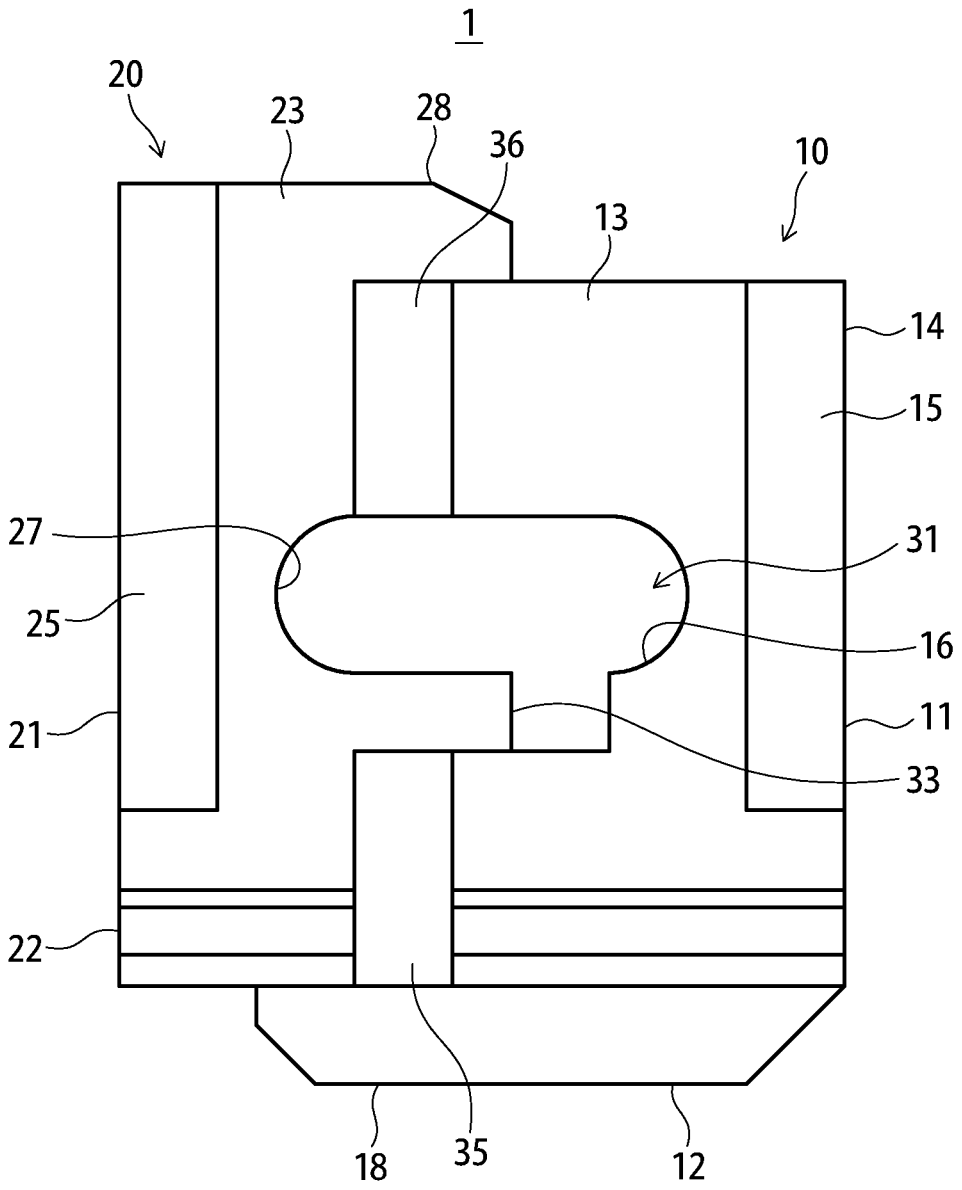
FIG. 5 is a plan view of the bucket tip end cover whose width is expanded.
Figure 6:
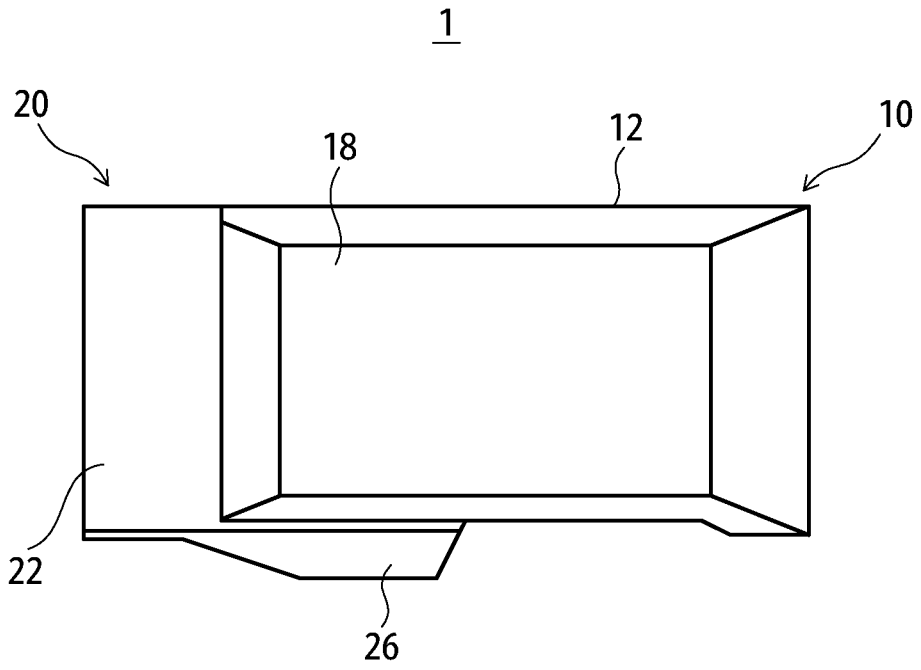
FIG. 6 is a front view of the bucket tip end cover whose width is expanded.
Figure 7:
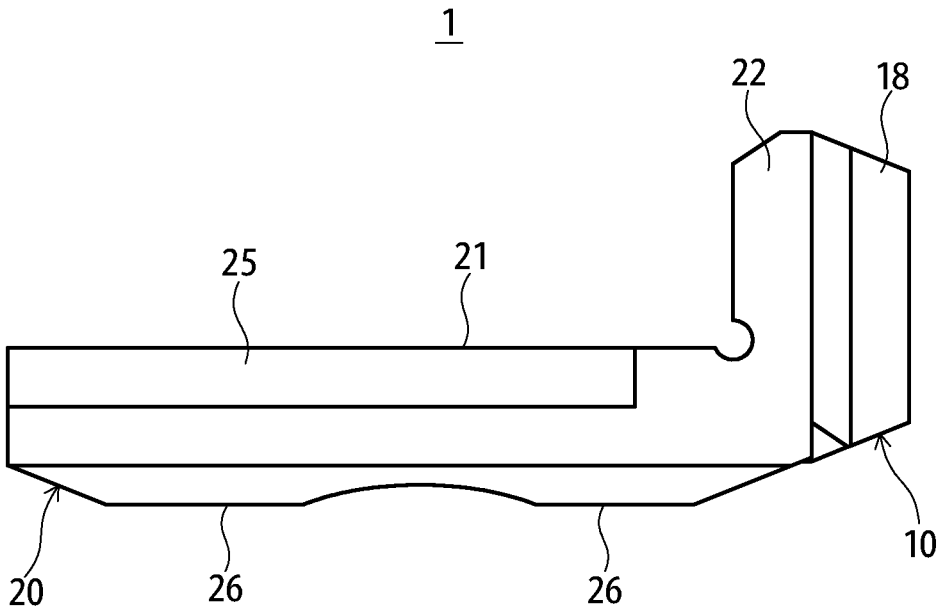
FIG. 7 is a side view of the bucket tip end cover whose width is expanded.
Figure 8:
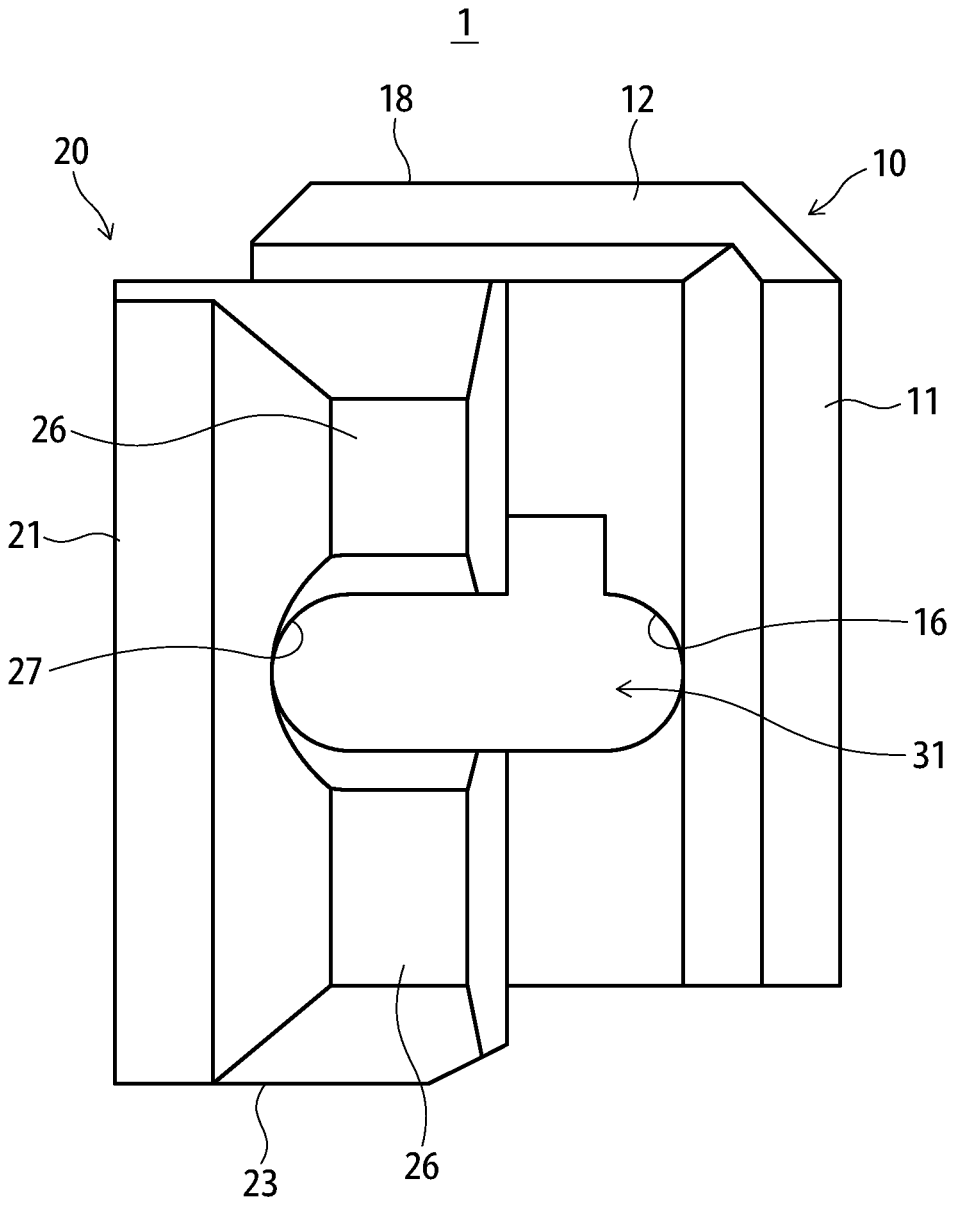
FIG. 8 is a bottom view of the bucket tip end cover whose width is expanded.

FIG. 1 is an enlarged partial plan view of a tip end 6 of a bucket 5 attached to a bucket tip end cover 1 in the present embodiment. FIGS. 2 to 4 are perspective views of the bucket tip end cover 1 whose width is expanded. FIG. 5 is a plan view of the bucket tip end cover 1 whose width is expanded. FIG. 6 is a front view of the bucket tip end cover 1 whose width is expanded. FIG. 7 is a side view of the bucket tip end cover 1 whose width is expanded. FIG. 8 is a bottom view of the bucket tip end cover 1 whose width is expanded.

In the present embodiment, a lower side as viewed in FIGS. 1 and 5 will be referred to as a "front side," and an upper side as viewed in these figures will be referred to as a "back side." Thus, a tip end side of the bucket 5 is the "front side."

Although not shown in the figure, the bucket 5 is mounted on an arm of a power shovel. As illustrated in FIG. 1, multiple adaptors 7 are provided at predetermined intervals at the tip end 6 of the bucket 5. Note that in FIG. 1, part of the tip end 6 of the bucket 5 is illustrated in close-up, and therefore, only two adaptors are illustrated in the figure. However, three or more adaptors 7 may be provided at the bucket 5.

The tip end 6 of the bucket 5 is formed in a plate shape. The adaptors 7 are fixed to the tip end 6 of the bucket 5 by welding. A tooth 8 as a drilling tool is attached to each adaptor 7. Moreover, the bucket tip end cover 1 is attached to the tip end 6 of the bucket 5 between adjacent ones of the adaptors 7. The bucket tip end cover 1 is for protecting the tip end 6 of the bucket 5, and is fixed to the tip end 6 of the bucket 5 by welding.

The bucket tip end cover 1 includes multiple cover members 10, 20 arranged at the tip end 6 of the bucket 5 between adjacent ones of the adaptors 7. The multiple cover members 10, 20 are configured such that each cover member 10, 20 is fixed to the bucket 5 in a state in which the cover members 10, 20 relatively move in an arraying direction (the direction of an arrow A as a right-to-left direction in FIG. 1) of the adaptors 7 to adjust an entire width in the arraying direction A. Hereinafter, details will be described.

Figure 9:
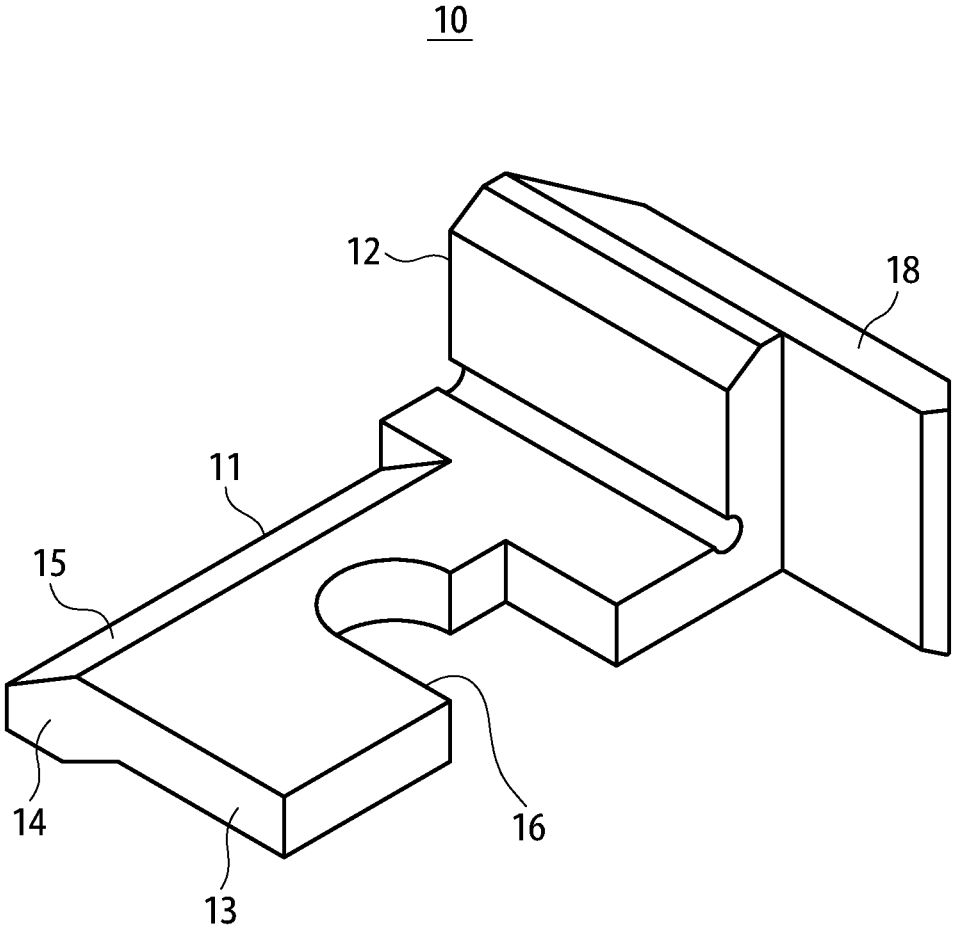
FIG. 9 is a perspective view of a first cover member.
Figure 10:
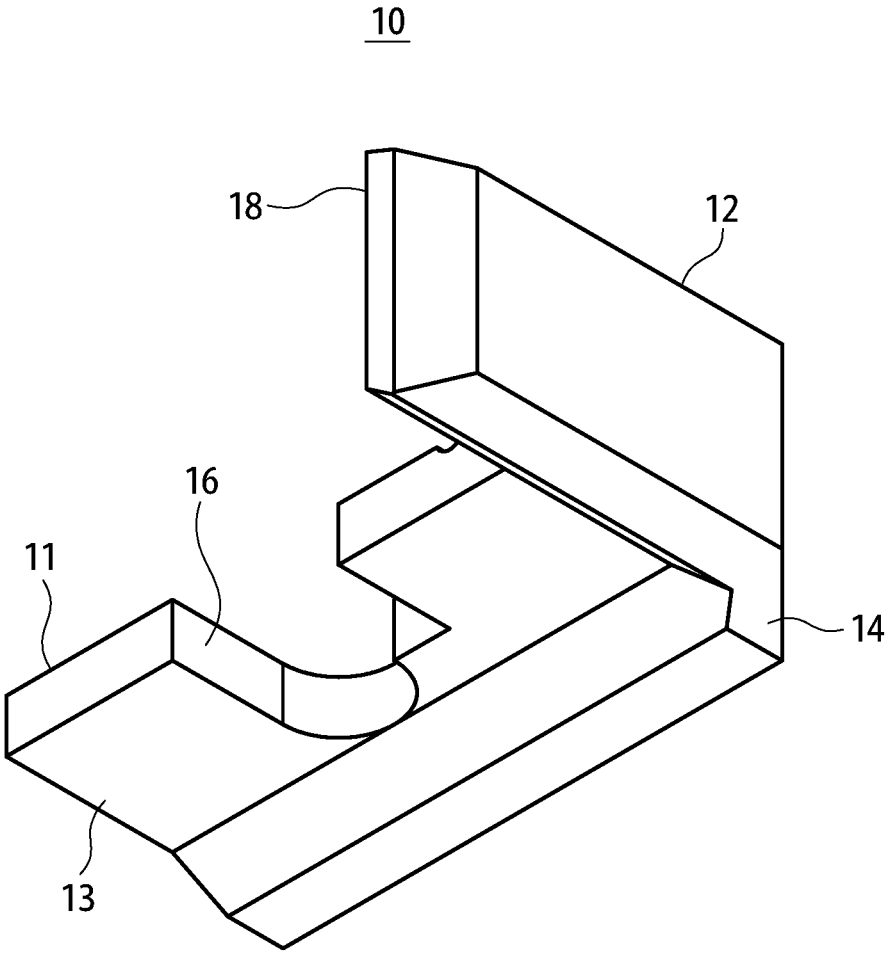
FIG. 10 is a perspective view of the first cover member.
Figure 11:
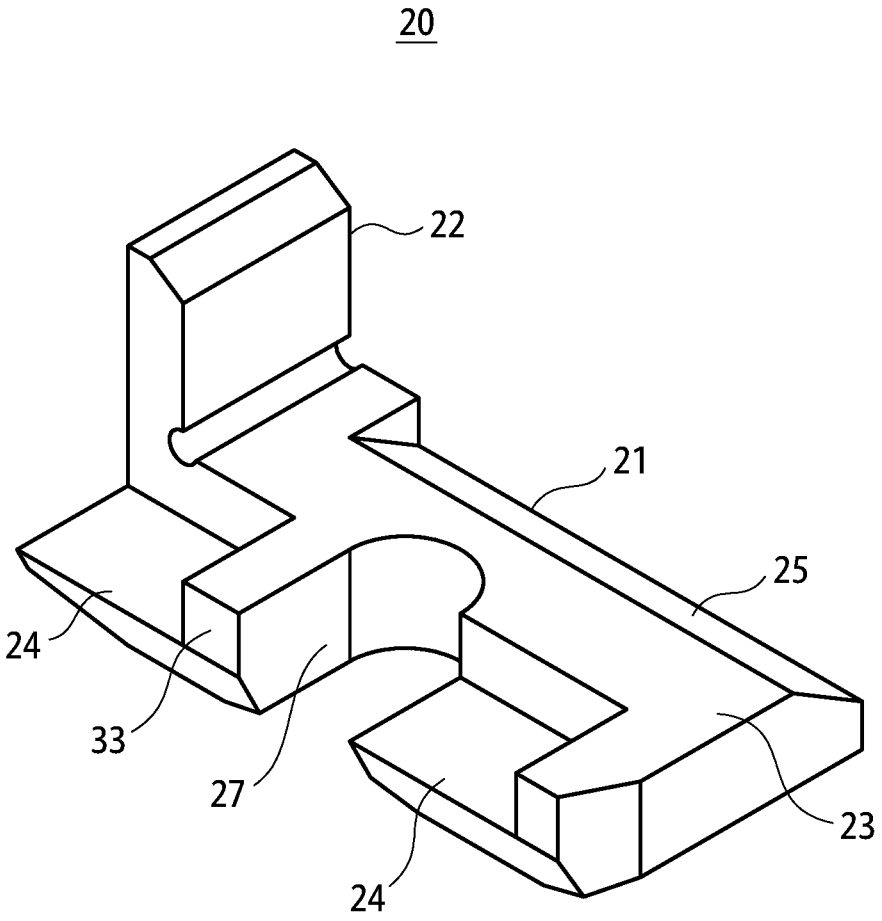
FIG. 11 is a perspective view of a second cover member.
Figure 12:
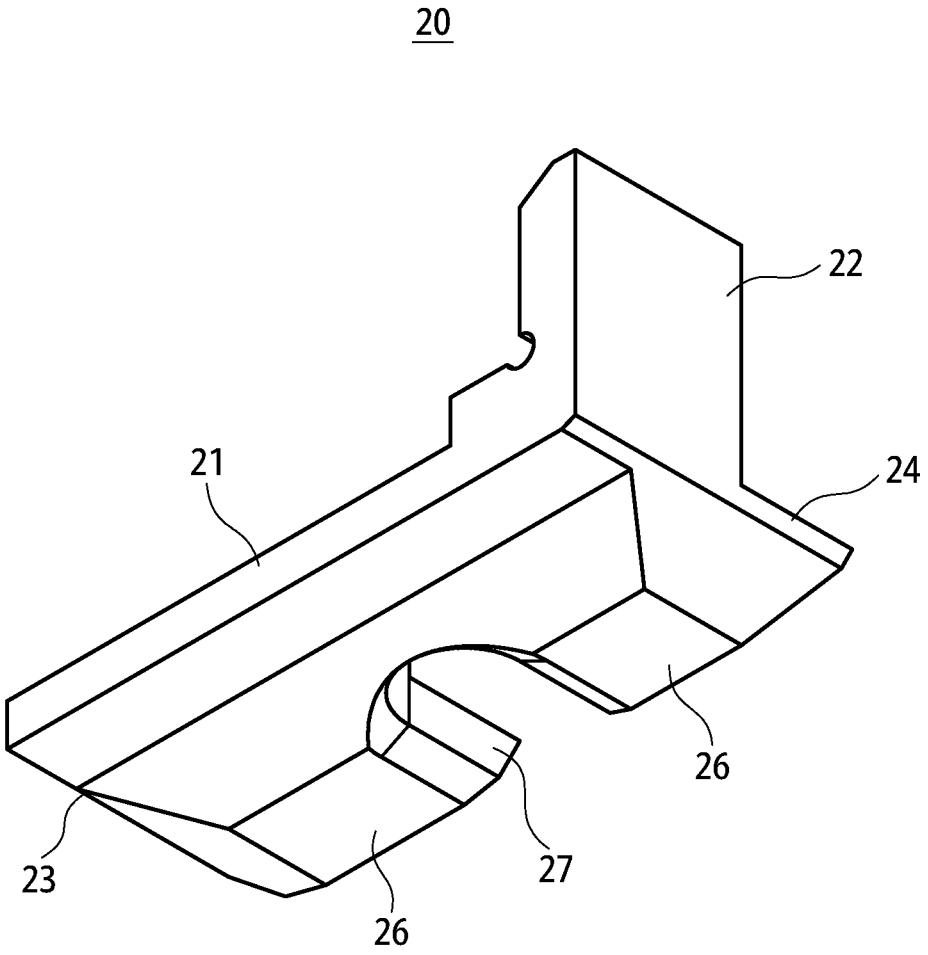
FIG. 12 is a perspective view of the second cover member.

FIGS. 9 and 10 are perspective views of a first cover member. FIGS. 11 and 12 are perspective views of a second cover member. The multiple cover members 10, 20 include a first cover member 10 and a second cover member 20 made of casting iron, for example.

As illustrated in FIGS. 9 and 10, the first cover member 10 has a first base portion 11 provided along an inner surface (a near side in the plane of paper of FIG. 1) or an outer surface (a far side in the plane of paper of FIG. 1) of the bucket 5, and a first front end portion 12 standing at a front end of the first base portion 11 to cover the tip end 6 of the bucket 5. The first base portion 11 of the present embodiment is provided along the outer surface (the far side in the plane of paper of FIG. 1) of the bucket 5.

The first base portion 11 has a plate-shaped flat plate portion 13, and an edge portion 14 formed at the side of the flat plate portion 13. The edge portion 14 is provided on the opposite side of the flat plate portion 13 from the second cover member 20. An inclined surface 15 is formed at the edge portion 14, and a welding portion is housed between the inclined surface 15 and the surface of the bucket 5. A first cutout portion 16 is formed at the substantially center of the flat plate portion 13. The first cutout portion 16 opens to the opposite side of the flat plate portion 13 from the edge portion 14. For resistance against impact from the front of the bucket 5 or wear, the first front end portion 12 has a relatively-large thickness in a front-to-back direction.

On the other hand, the second cover member 20 has a second base portion 21 provided along the inner surface (the near side in the plane of paper of FIG. 1) or the outer surface (the far side in the plane of paper of FIG. 1) of the bucket 5, and a second front end portion 22 standing at a front end of the second base portion 21 to cover the tip end 6 of the bucket 5, as illustrated in FIGS. 11 and 12. As in the first base portion 11, the second base portion 21 of the present embodiment is provided along the outer surface (the far side in the plane of paper of FIG. 1) of the bucket 5.

The second base portion 21 has a base body 23 and step portions 24 formed on a side of the base body 23 close to the first cover member 10. As illustrated in FIG. 11, an inclined surface 25 is formed at the base body 23, and the welding portion is housed between the inclined surface 25 and the surface of the bucket 5. Moreover, as illustrated in FIG. 12, a protrusion 26 is formed outside (the opposite side of the bucket 5) the second base portion 21.

A second cutout portion 27 is formed on a side of the second base portion 21 close to the first cover member 10. The step portions 24 are provided on both sides of the second cutout portion 27 in the front-to-back direction. In other words, two step portions 24 are provided next to each other in the front-to-back direction at the second base portion 21, and the second cutout portion 27 is arranged between these two step portions 24.

As illustrated in FIGS. 2 to 5, the step portions 24 overlap with the flat plate portion 13 of the first cover member 10 in a state in which the first cover member 10 and the second cover member 20 are assembled with each other. Moreover, the first cutout portion 16 and the second cutout portion 27 form a single long-hole-shaped opening 31 in a state in which the first cover member 10 and the second cover member 20 are assembled with each other. The opening 31 is for welding the first cover member 10 and the second cover member 20 to the surface of the bucket 5 at an inner peripheral edge of the opening 31.

As illustrated in FIG. 11, the second base portion 21 has a center protruding portion 33 standing on the step portion 24. The center protruding portion 33 is formed on one of the step portions 24, and a side surface of the center protruding portion 33 defines part of the second cutout portion 27.

Figure 13:
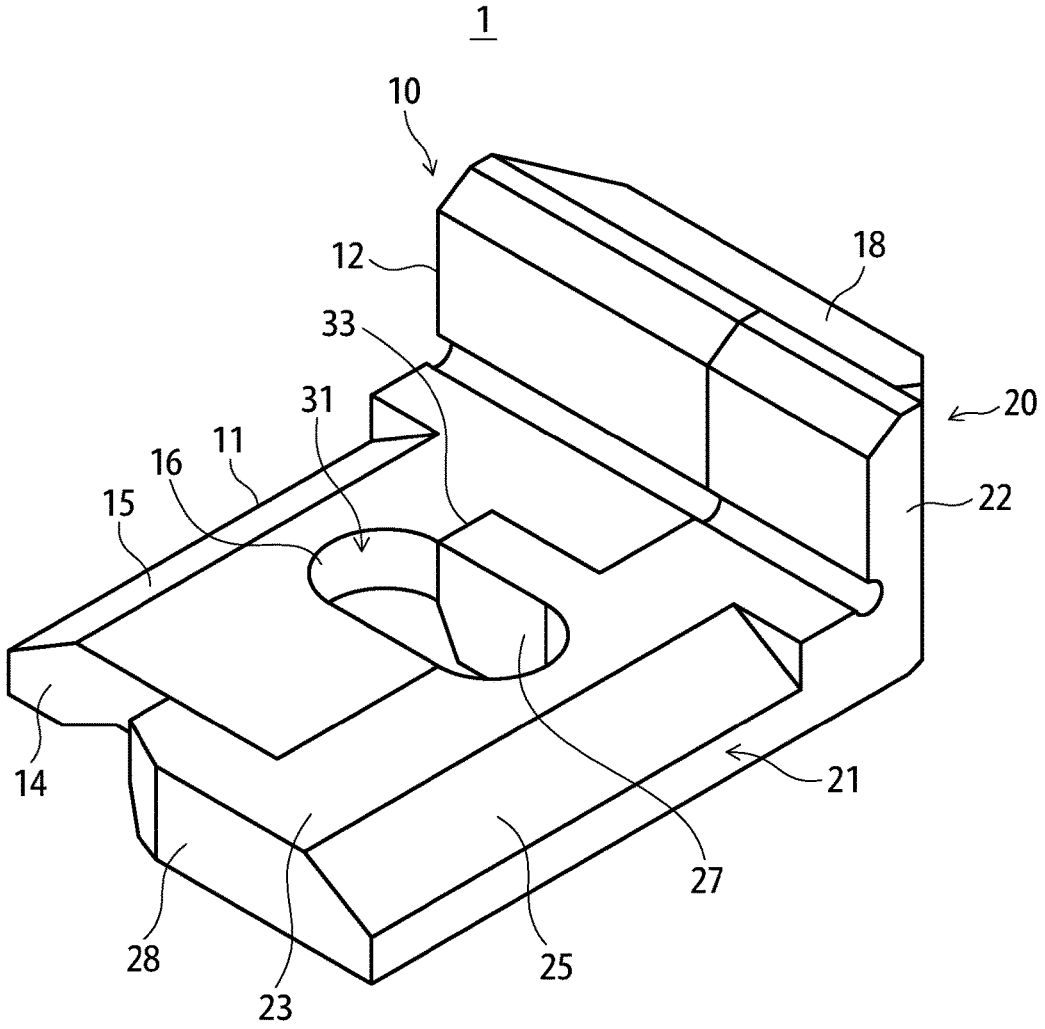
FIG. 13 is a perspective view of the bucket tip end cover whose width is narrowed.
Figure 14:
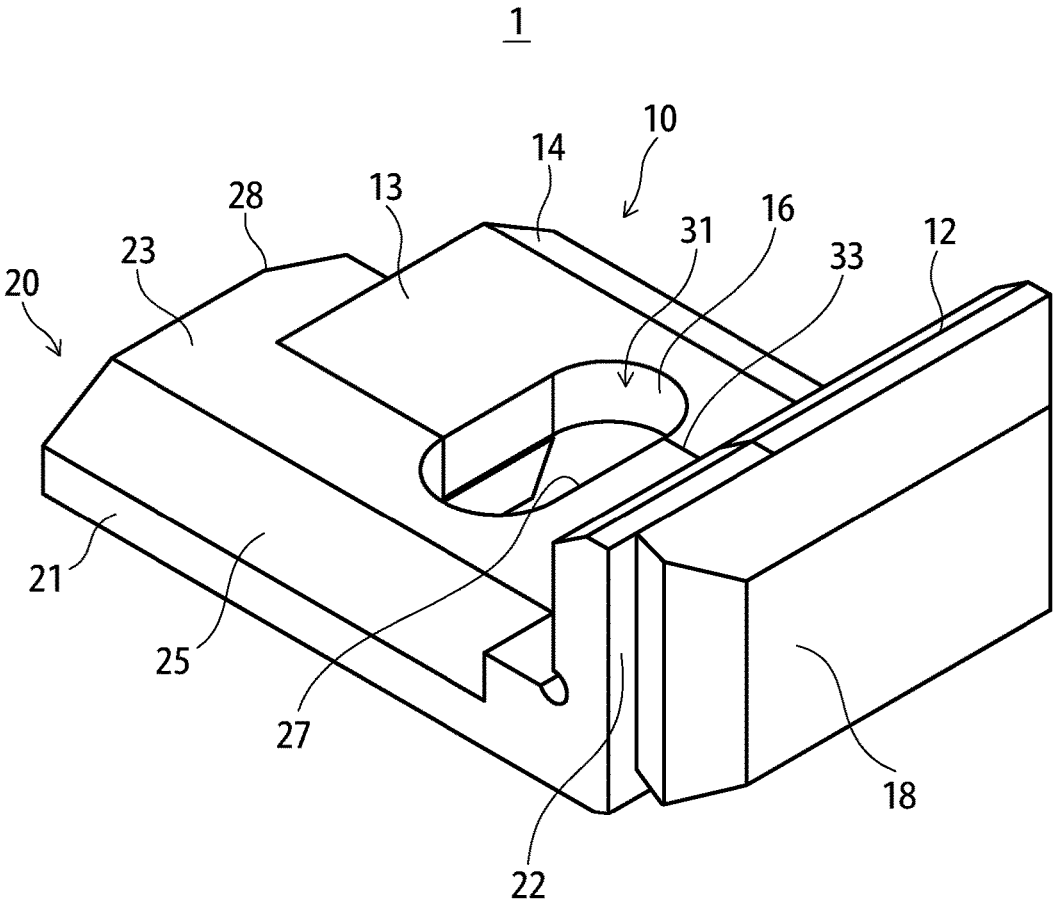
FIG. 14 is a perspective view of the bucket tip end cover whose width is narrowed.
Figure 15:
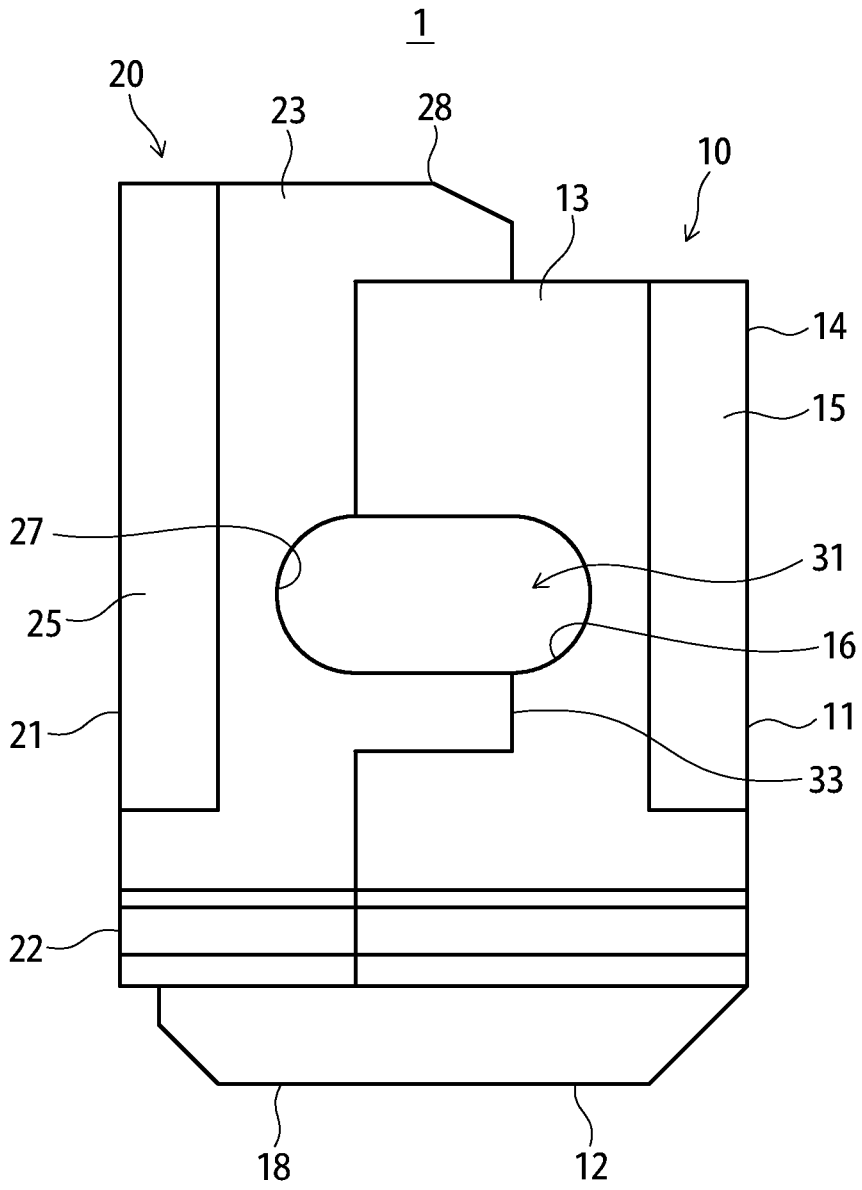
FIG. 15 is a plan view of the bucket tip end cover whose width is narrowed.
Figure 16:
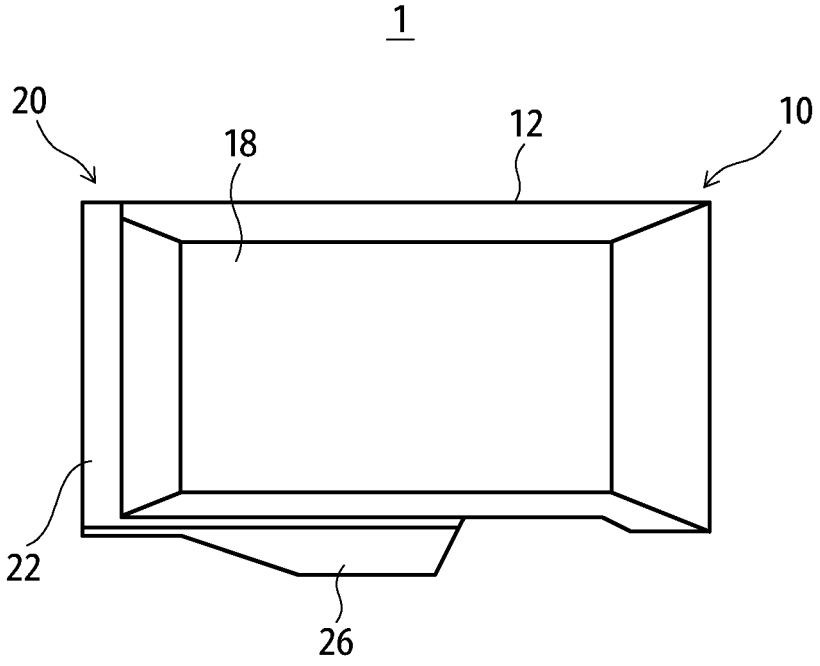
FIG. 16 is a front view of the bucket tip end cover whose width is narrowed.
Figure 17:
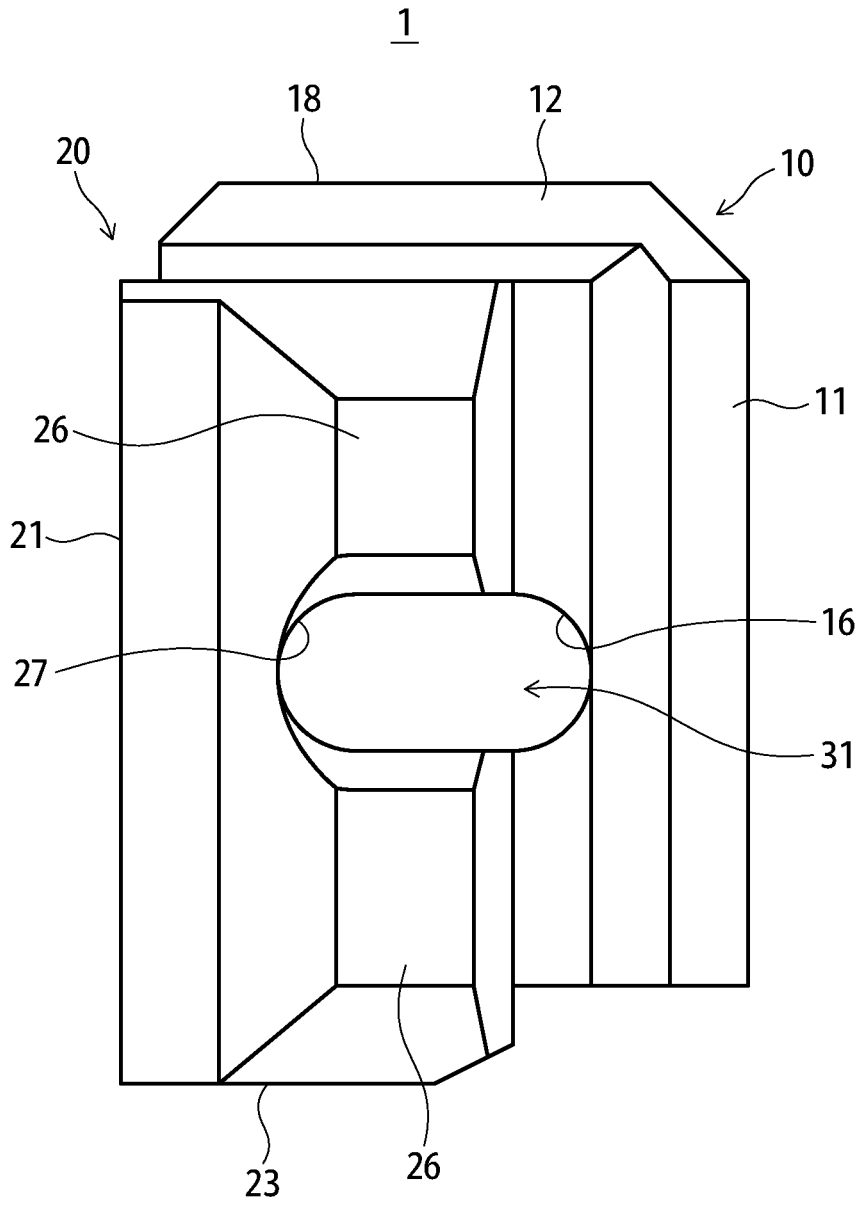
FIG. 17 is a bottom view of the bucket tip end cover whose width is narrowed.

FIGS. 13 and 14 are perspective views of the bucket tip end cover 1 whose width is narrowed. FIG. 15 is a plan view of the bucket tip end cover 1 whose width is narrowed. FIG. 16 is a front view of the bucket tip end cover 1 whose width is narrowed. FIG. 17 is a bottom view of the bucket tip end cover 1 whose width is narrowed.

As illustrated in FIGS. 13 to 17, the bucket tip end cover 1 is configured such that the width of the bucket tip end cover 1 is narrowed in such a manner that the first cover member 10 and the second cover member 20 relatively move in an approaching direction. Then, the bucket tip end cover 1 is welded and fixed to the bucket 5 with the bucket tip end cover 1 being adjusted to a desired width.

The center protruding portion 33 of the second cover member 20 is configured such that a side surface on the opposite side of the side surface defining the second cutout portion 27 is guided by a side surface of the first cutout portion 16 when the first cover member 10 and the second cover member 20 are combined and relatively moved right to left. Further, the center protruding portion 33 is provided so that the strength of the second base portion 21 can be enhanced.

As illustrated in FIG. 2, the first front end portion 12 includes a first shielding portion 18 configured to shield, from the front, a clearance 35 formed between the first front end portion 12 and the second front end portion 22. The first shielding portion 18 is configured to shield, from the front, not only the clearance 35 but also a clearance 36 formed between the first base portion and the second base portion. In other words, the first shielding portion 18 shields, from the front, the clearances 35, 36 which might be formed at a front end of the bucket tip end cover 1.

A front surface of the second front end portion 22 is configured to guide a back surface of the first shielding portion 18 when the first cover member 10 moves right to left relative to the second cover member 20. That is, the first shielding portion 18 relatively moves along the front surface of the second front end portion 22.

Further, the second base portion 21 includes a second shielding portion 28 configured to shield, from the back, the clearance 36 formed between the second base portion 21 and the first base portion 11. A back surface of the first base portion 11 is configured to guide a front surface of the second shielding portion 28 when the first cover member 10 moves right to left relative to the second cover member 20. That is, the second shielding portion 28 relatively moves along the back surface of the first base portion 11.

In a state in which the entire width in the arraying direction A of the adaptors 7 is adjusted by relative movement of the first cover member 10 and the second cover member 20 in the arraying direction A, the bucket tip end cover 1 is fixed to the bucket 5 by welding.

Thus, according to the first embodiment, the bucket tip end cover 1 includes the multiple cover members (the first cover member 10 and the second cover member 20), and therefore, the width of the bucket tip end cover 1 in the arraying direction A of the adaptors 7 can be adjusted as necessary in such a manner that each cover member (the first cover member 10 and the second cover member 20) relatively moves in the arraying direction A. Thus, even for the bucket 5 with different intervals of the tooth 8, the width of the bucket tip end cover 1 is changed as necessary according to the interval of the tooth 8 so that protection of the tip end 6 of the bucket 5 can be enhanced.

When the first cover member 10 and the second cover member 20 are separated from each other to expand the width of the bucket tip end cover 1, the clearance 35 is formed between the first front end portion 12 of the first cover member 10 and the second front end portion 22 of the second cover member 20. In the present embodiment, it is configured such that the clearance 35 is shielded from the front by the first shielding portion 18. Thus, not only the strength of a front end portion of the bucket tip end cover 1 having the first front end portion 12 and the second front end portion 22 is enhanced, but also entrance of dirt etc. into the clearance 35 from the tip end side (i.e., the front of the bucket 5) of the bucket 5 upon a drilling process can be prevented. Further, not only the clearance 35 between the first front end portion 12 and the second front end portion 22 but also the clearance 36 between the first base portion 11 and the second base portion 21 can be shielded by the first shielding portion 18. Thus, entrance of dirt etc. into these clearances 35, 36 from the front can be prevented.

By operation of the arm of the power shovel, the bucket 5 not only moves forward to the tip end side, but also moves backward to the opposite side. In the present embodiment, it is configured such that the clearance 36 between the first base portion 11 and the second base portion 21 is shielded from the back by the second shielding portion 28. Thus, entrance of dirt etc. into the clearance 36 from the back of the bucket upon drilling of dirt etc. or a leveling process for dirt etc. can be prevented.

The front surface of the second front end portion 22 can support the back surface of the first shielding portion 18. In addition, the front surface of the second shielding portion 28 can support the back surface of the first base portion 11, and a front surface of the center protruding portion 33 can support a back surface of the first cutout portion. Thus, the first cover member 10 can be firmly supported by the second cover member 20. Thus, the bucket tip end cover 1 of the present embodiment has enhanced strength against impact from the front upon the drilling process.

Second Embodiment

Figure 18:
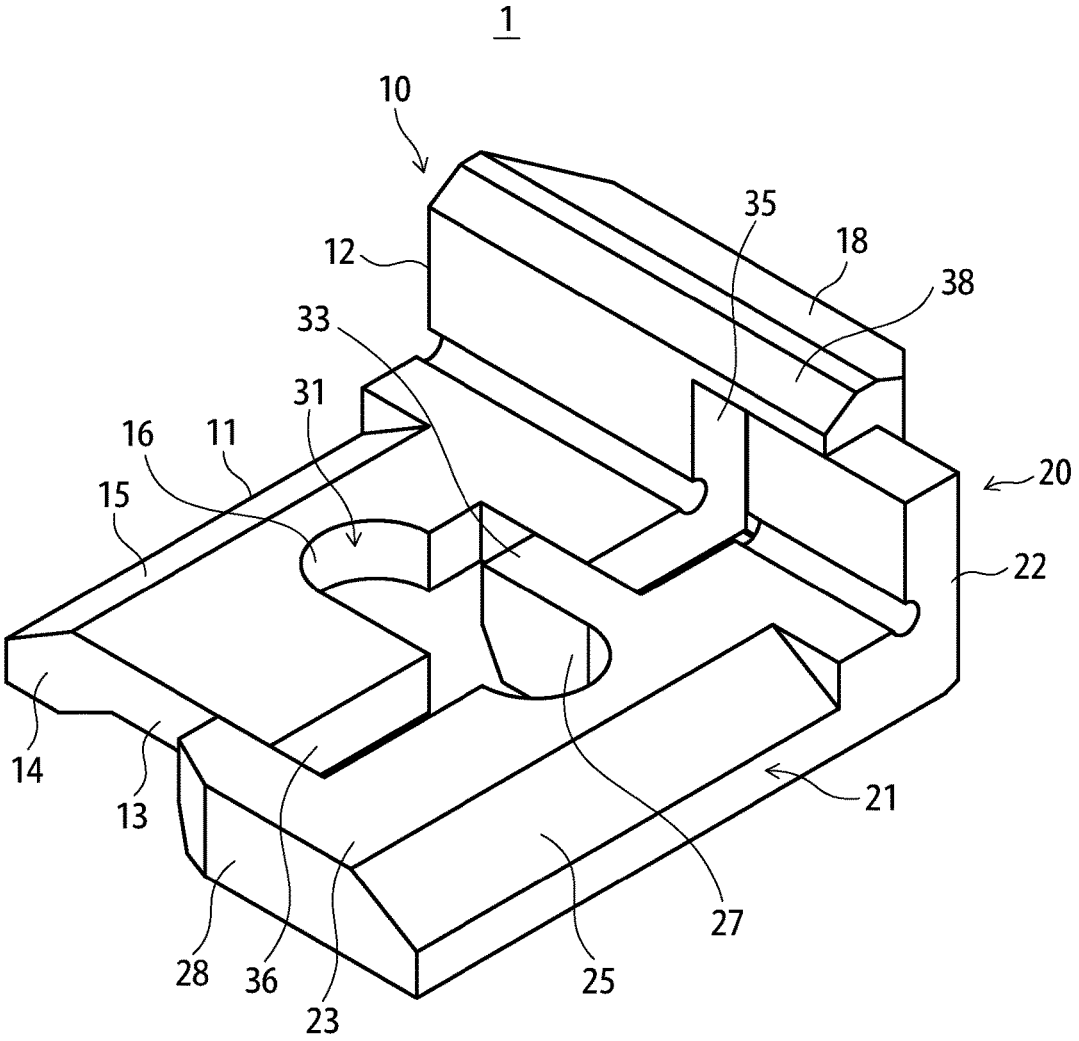
FIG. 18 is a perspective view of a bucket tip end cover whose width is expanded in a second embodiment.
Figure 19:
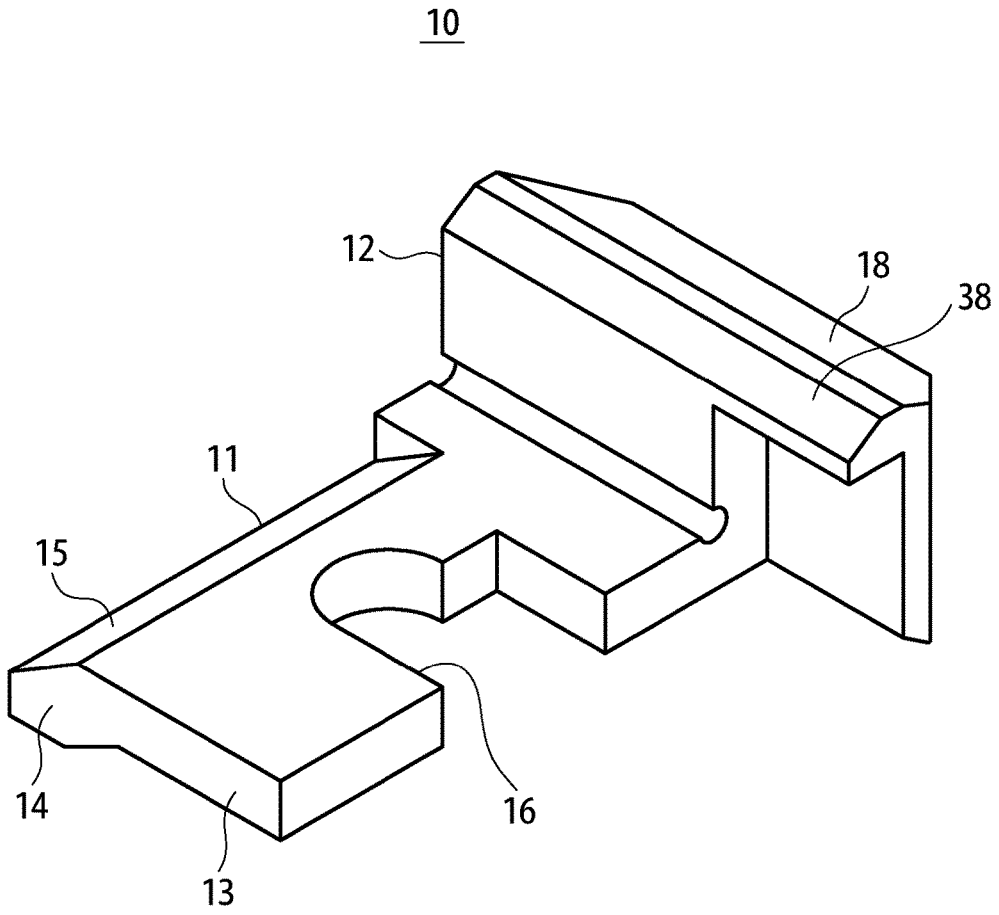
FIG. 19 is a perspective view of a first cover member.
Figure 20:
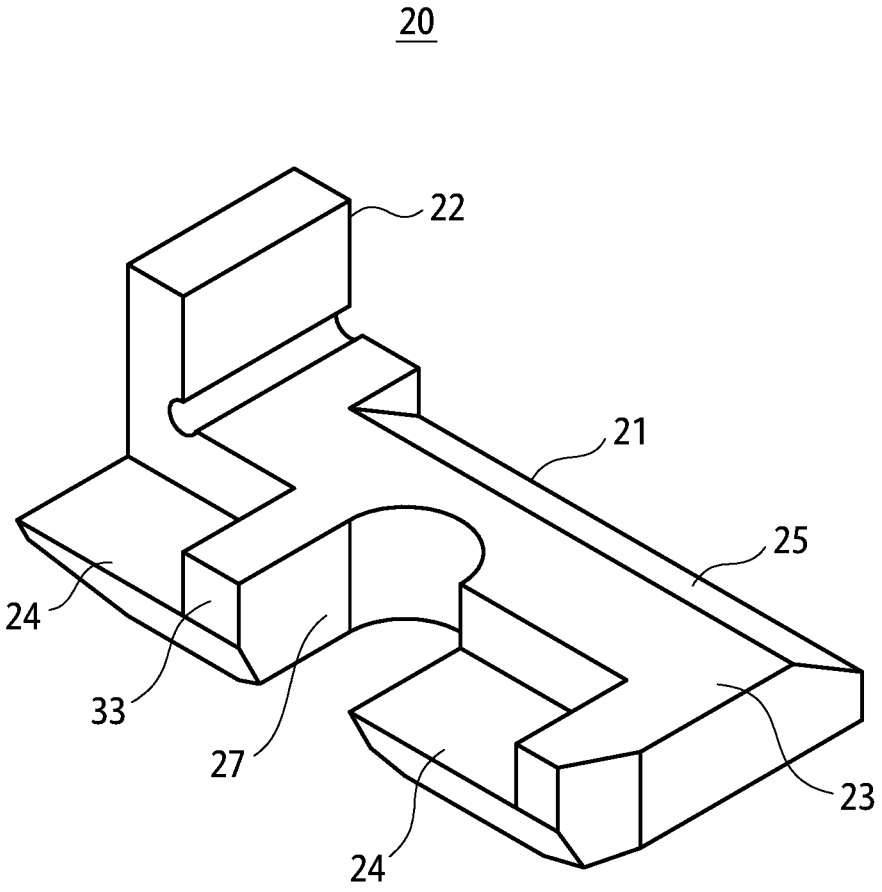
FIG. 20 is a perspective view of a second cover member.

Next, a second embodiment will be described with reference to FIGS. 18 to 20. FIG. 18 is a perspective view of a bucket tip end cover 1 whose width is expanded in the second embodiment. FIG. 19 is a perspective view of a first cover member 10. FIG. 20 is a perspective view of a second cover member 20. Note that configurations similar to those of the first embodiment above will not be described.

As illustrated in FIGS. 18 to 20, the bucket tip end cover 1 of the second embodiment is configured such that a first front end portion 12 of the first cover member 10 includes a third shielding portion 38 in addition to a first shielding portion 18. The third shielding portion 38 is configured to shield a clearance 35 formed between a first front end portion 12 and a second front end portion 22 from a protruding side (i.e., an upper side in FIG. 18) of the second front end portion 22 from a second base portion 21. The third shielding portion 38 is formed integrally with the first shielding portion 18.

According to the second embodiment, the first shielding portion 18 and the third shielding portion 38 are integrally formed so that the entire strength of the first front end portion 12 can be enhanced. In addition, entrance of dirt etc. into the clearance 35 between the first front end portion 12 and the second front end portion 22 upon a drilling process of a bucket 5 can be prevented not only from a tip end side (i.e., the front of the bucket 5) of the bucket 5 but also the protruding side (i.e., the upper side in FIG. 18) of the second front end portion 22.

Note that in description above, the example where the first base portion 11 and the second base portion 21 are provided along the outer surface (the far side in the plane of paper of FIG. 1) of the bucket 5 has been described. However, the first base portion 11 and the second base portion 21 may be provided along the inner surface (the near side in the plane of paper of FIG. 1) of the bucket 5. With this configuration, advantageous effects similar to those described above can be also obtained. Moreover, in description above, the example where the bucket tip end cover 1 includes two cover members 10, 20 has been described, but the bucket tip end cover 1 may include three or more cover members.

INDUSTRIAL APPLICABILITY

As described above, the present disclosure is useful for a bucket tip end cover attached to a tip end side of a bucket for a shovel machine.

LIST OF REFERENCE NUMERALS

A arraying direction
1 bucket tip end cover
5 bucket
6 tip end
7 adaptor
8 tooth (drilling tool)
10 first cover member
11 first base portion

12 first front end portion
16 first cutout portion (cutout portion)
18 first shielding portion
20 second cover member
21 second base portion
22 second front end portion
28 second shielding portion
33 center protruding portion
35, 36 clearance
38 third shielding portion

The invention claimed is:

1. A bucket tip end cover fixed to a tip end of a bucket exposed in a state in which drilling tools are each attached to adaptors to protect the tip end of the bucket, the adaptors being provided at a predetermined interval at the bucket, said bucket tip end cover comprising:

a first cover member and a second cover member arranged at the tip end of the bucket between adjacent ones of the adaptors, wherein the first cover member and the second cover member are configured to overlap and be adjustable with respect to each other in an arraying direction between the adapters such that an entire width in the arraying direction between the adaptors is covered and, after such width adjustment, the cover members are fixed to the bucket, the first cover member includes a first base portion provided along an inner surface or an outer surface of the bucket, and a first front end portion standing at a front end of the first base portion to cover the tip end of the bucket, the second cover member includes a second base portion provided along the inner surface or the outer surface of the bucket, and a second front end portion standing at a front end of the second base portion to cover the tip end of the bucket, a cutout portion is formed at a substantially center of the first base portion, and a center protruding portion having a front surface configured to support a back surface of the cutout portion is formed at the second base portion.

2. The bucket tip end cover according to claim 1, wherein the first front end portion includes a first shielding portion configured to shield, from a front, a clearance formed between the first front end portion and the second front end portion.

3. The bucket tip end cover according to claim 2, wherein the first shielding portion is configured to shield, from the front, a clearance formed between the first base portion and the second base portion.

4. The bucket tip end cover according to claim 1, wherein the second base portion includes a shielding portion configured to shield, from a back, a clearance formed between the second base portion and the first base portion.

5. The bucket tip end cover according to claim 2, wherein the first front end portion includes a second shielding portion configured to shield, from a protruding side of the second front end portion from the second base portion, the clearance formed between the first front end portion and the second front end portion.

* * * * *